United States Patent [19]

Schindler et al.

[11] Patent Number: 5,050,419

[45] Date of Patent: Sep. 24, 1991

[54] METHOD FOR ELIMINATING OF LONGITUDINAL UPSET SEAMS

[75] Inventors: Michael J. Schindler, Ratingen; Wulff-Eckard Von Borcke, Haan, both of Fed. Rep. of Germany

[73] Assignee: Mannesmann Aktiengesellschaft, Düsseldorf, Fed. Rep. of Germany

[21] Appl. No.: 508,010

[22] Filed: Apr. 10, 1990

[30] Foreign Application Priority Data

Apr. 12, 1989 [DE] Fed. Rep. of Germany ..... 3912423

[51] Int. Cl.[5] ..... B21J 05/06

[52] U.S. Cl. ..... 72/306; 72/356

[58] Field of Search ..... 72/306, 318, 353.2, 72/354.6, 356, 360, 377

[56] References Cited

U.S. PATENT DOCUMENTS 2,027,406 1/1936 Spatta ..... 72/356

2,212,903 8/1940 Steigerwalt ..... 72/377

3,570,298 3/1971 Detzel et al. ..... 72/377

*Primary Examiner*—Lowell A. Larson

*Attorney, Agent, or Firm*—Cohen, Pontani & Lieberman

[57] ABSTRACT

In accordance with the invention, immediately after the completion of the upsetting process using an upset tool to form a pipe end of increased wall thickness, the upset half shells which have been pressed together are opened and the supporting mandrel is withdrawn. After the lifting of the pipe end out of the tool, the longitudinal upset seams formed during the upset operation are rotated through a predetermined angle in a plane to which the axis of the pipe is perpendicular and out of the parting plane of the upset half shells. The pipe end is again pressed into the working plane while maintaining its previous axial position to the tool. After the reintroduction of the supporting mandrel, the pipe end is additionally pressed radially to substantially eliminate the longitudinal upset seams.

9 Claims, 1 Drawing Sheet

METHOD FOR ELIMINATING OF LONGITUDINAL UPSET SEAMS

FIELD OF THE INVENTION

The present invention relates to a method of eliminating longitudinal upset seams which are formed when pipe ends are subjected to wall thickness enlargement by the application of axial pressure from an axially pressing support mandrel having an abutment collar and by the application of radial pressure from a pair of upset half shells.

BACKGROUND OF THE INVENTION

In the manufacture of pipes which are to be threaded to each other, for the petroleum and natural gas industry, it is necessary to increase the wall thickness in the end region depending on the stress in the field of use and the type of thread cut. This is done in known fashion in the manner that a given length at the end of the pipe is hot upset in an upset machine and its wall thickness thereby increased. In this process, longitudinal upset seams are formed in the upset region on the outside of the end of the pipe since tie rods which press the two upset half shells to each other are elastically stretched during the upsetting and material flows into the gap produced thereby between the two upset half shells. As a result of this flow, and furthermore with an increasing number of upsets, the edges of the upset half shells also gradually become worn within a given region, so that the gap becomes larger and larger. The longitudinal upset seams disturb the subsequent working to precise dimensions on a lathe since the undisturbed flow of chips is prevented at this place and the impact-like loading leads to increased wear of the tool and the mounting of the tool holder is also impaired. Even if the loading of the machine tool is tolerated, these seams are nevertheless disturbing since they lead to a radial offset of the pipe end to be machined within the chuck of the lathe.

Up to now, as is known, the longitudinal upset seams which are formed have been eliminated by grinding. This manual cleaning of the hot-upset pipe ends is cost-intensive as a result of the expense for personnel, and the quality of the surface obtained is dependent also on the subjective judgment of the operator. For highly stressed pipe connections, manual grinding also constitutes a danger since, depending on the quality of the manual grinding work, injurious notches can be formed which may lead to failure of the thread connection.

An object of the present invention is to provide a method which can be integrated into the manufacturing process and by which it is possible, in a cost-favorable manner, to eliminate the longitudinal upset seams formed upon the hot upsetting of pipe ends so that, with the better surface, the subsequent precision machining can be increased in quality and output and the permanence of highly stressed pipe connections is not reduced.

SUMMARY OF THE INVENTION

The invention provides a method for eliminating longitudinal upset seams which are formed when pipe ends are subjected to wall thickness enlargement by the application of axial pressure from an axially pressing support mandrel having an abutment collar and by the application of radial pressure from a pair of upset half shells. In accordance with the invention, immediately after the completion of the upsetting process using an upset tool, the upset half shells which have been pressed together are opened and the supporting mandrel is withdrawn. After the lifting of the pipe end out of the tool, the longitudinal upset seams formed during the upset operation are rotated through a predetermined angle, for example in a plane to which the axis of the pipe is perpendicular, and out of the parting plane of the upset half shells. The pipe end is again pressed into the working plane while maintaining its previous axial position to the tool. After the reintroduction of the supporting mandrel, the pipe end is additionally pressed radially to substantially eliminate the longitudinal upset seams.

BRIEF DESCRIPTION OF THE PREFERRED EMBODIMENT

An upset machine for increasing the wall thickness of a pipe end generally includes (a) an induction coil, or some other type of heating element for heating the pipe end prior to working; (b) a support mandrel having an abutment collar for preventing unwanted distortion of the inner dimensions of the pipe end and for axially pressing the pipe end to cause an increase in the wall thickness thereof; and (c) a tool comprising a pair of upset half shells for radially pressing the pipe end into a predetermined configuration. Such upset machines, being well-known in the art, will not be further described.

As noted above, when the upset half shells are pressed together a longitudinal upset seam is formed in the gap between them. In accordance with the invention such longitudinal upset seams are wholly eliminated or at the very least substantially eliminated in the manner described below.

As used herein, the phrase "radial pressing" means the application of radial pressure using the upset half shells without applying axial pressure from the abutment collar of the support mandrel.

As used herein, the phrase "upset pressing" means the application of axial pressure using the support mandrel with abutment collar in addition to applying radial pressure using the upset half shells.

Figure 1:
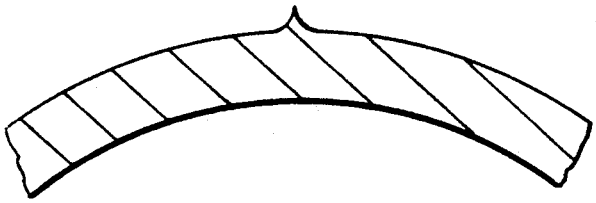
FIG. 1 PRIOR ART
FIG. 1. shows a partial cross-sectional view of a sharp-tipped longitudinal upset seam when a prior art split tool is used to upset pipe ends.

As shown in FIG. 1, when a prior art split tool is used to upset pipe ends, a sharp-tipped longitudinal upset seam is formed between the two halves of the upset tool as they come together during operation. In accordance with the present invention, the type of sharp-tipped seam illustrated in FIG. 1 is to be avoided.

Figure 2:
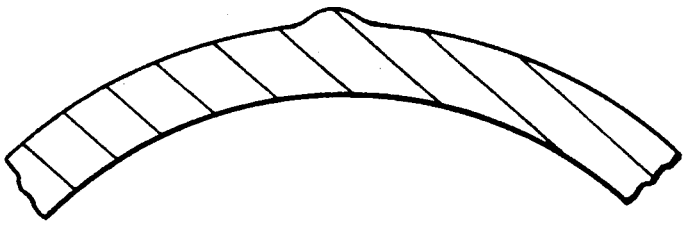
FIG. 2. shows a partial cross-sectional view of a lens-shaped longitudinal upset seam when the claimed methods are used.

As shown in FIG. 2, when the claimed methods are used, a lens-shaped or lenticular, i.e., relatively flat, longitudinal upset seam is formed which minimizes the need for subsequent machining of the pipe end following the upset operation.

In the method of the invention, the longitudinal upset seams formed are eliminated immediately after the completion of the upset process in the form of a further manufacturing step under the same heat. For this purpose, after the upset half shells have been opened and the support mandrel withdrawn and the pipe end lifted out of the tool, the pipe is turned through a predetermined angle and then let down again into the working region. The upset seams then no longer lie in the original parting plane of the upset half shells but are displaced by said predetermined angle in the corresponding upset half shell. As an alternative to the turning of the pipe, it is also possible to turn the tool set. This, however, means a substantial expenditure in the construction of the upset machines and the machines already in existence would have to be refitted for this. After the closing of the upset half shells again, the protruding or bulge seam material is forced away radially, the support mandrel, which has been introduced, preventing ovalization of the inside diameter of the pipe end. It is important in this connection that the seams formed upon the upsetting process be so developed in their cross-sectional geometry that the forcing away is favored and no puckering can be produced. This is most easily achieved if the upset seam formed is developed in lenticular shape of only slight radial extent and with rounded transitions into the surrounding region. Furthermore puckering can also be avoided if the rotation of the pipe is effected within a region of around 90° so that the apex region of the upset half shell presses, insofar as possible, symmetrically on the upset seam and, in the ideal case, the material flows away uniformly on both sides. In order to save expense, subsequent heating of the upset region of the pipe end is not provided for; rather the residual heat still remaining from the upset process is utilized for the elimination of the upset seams.

Depending on the type of machine, two procedures are possible. In the case of an upset machine having only one set of tools and a hydraulically translatable support mandrel, the subsequent pressing is preferably effected in the same tool set, the support mandrel not being introduced entirely all the way so as to avoid even a slight axial initial upset in each case. It is important in connection with the turning of the pipe that the axial position of the end of the pipe with respect to the tool be retained since otherwise the contour which has already been initially upset is impaired. The introduction of the support mandrel is also preferable so that upon the subsequent pressing the inner contour is retained and the cross-section cannot be ovalized.

In an upset machine with two tool sets, the subsequent pressing is preferably carried out in the second tool set which lies parallel thereto, in which connection one then has the possibility of modifying the inner contour of the upset half shells for an easier forcing away of the seams. Furthermore, in the case of such a combination, one can use a support mandrel without upset collar, so that the limiting of the introduction for the support mandrel is unimportant.

The method proposed can, in the case of multiple upsettings, be carried out after each upset process in order to obtain the smoothest possible surface in the region of the pipe end and, in any event however, after the last upset process. The advantage of the method in accordance with the invention is that manual cleaning can be dispensed with. Another advantage of the method is that the existing upset machines can be used without change, and the required reconversion in the feed region is structurally simple and inexpensive.

In the case of single-step and multi-step upset machines, the subsequent pressing does not mean any loss in cycle time since sufficient time remains for the cooling, cleaning and lubricating of the tool set for the radial subsequent pressing. In this connection it is to be born in mind that the actual cycle time for the hot upsetting of two pipe ends is not determined by the upsetting and the subsequent treatment of the tool set but by the heating of the pipe ends in the induction coils which are arranged in front.

The problem of gradual wear of the edge of the upset half shells which has already been mentioned is unimportant in the method of the present invention since the geometry of the seams produced thereby accommodates the forcing away of the material with the greatest possible elimination of puckering. The size of the amount of material to be pressed away is of minor importance in the method of the invention, while upon manual grinding the time expended increases in direct proportion to the increase in volume of the seam.

Thus in a more preferred embodiment of the invention, the inner contour, the supporting cross-section and the elasticity behavior of the tool are selected, as will be within the ability of persons skilled in the art, so that the upset seam formed is lenticular in shape, of only slight radial extent and with a rounded transition into the surrounding region of the pipe end.

It should be understood that the preferred embodiments described are for illustrative purposes only and are not to be construed as limiting the scope of the present invention which is properly delineated only in the appended claims.

What is claimed is:

1. A method of eliminating longitudinal upset seams which are formed upon the hot upsetting of pipe ends by means of a tool comprising upset half shells which are pressed together in pairs and an axially pressing supporting mandrel which has an abutment collar, the supporting cross-section and the elasticity behavior of the tool being selected to form a lens-shaped upset seam of only slight radial extent and with a rounded transition into the surrounding region of the pipe being upset, said method comprising:

a. opening the upset half shells which have been pressed together and withdrawing the supporting mandrel immediately after the completion of the process, b. lifting the pipe end out of the tool, c. rotating the longitudinal upset seams formed in the pipe end through a predetermined angle relative to the tool and out of the parting plane of the upset half shells, d. pressing the pipe end between the upset half shells while maintaining the pipe end's previous axial position to the tool and, e. after the introduction of the supporting mandrel, additionally pressing the pipe end radially without using the abutment collar to exert axial upset forces.

2. The method according to claim 1, wherein the tool is stationary when the pipe is turned through the predetermined angle.

3. The method according to claim 2, wherein the same pair of upset half shells is used to perform step (e) as was used for the initial upsetting process.

4. The method according to claim 2, wherein a second parallel pair of upset half shells is used to perform step (e).

5. The method according to claim 1, wherein the same pair of upset half shells is used to perform step (e) as was used for the initial upsetting process.

6. The method according to claim 5, wherein during the radial subsequent pressing in step (e), a support mandrel without an abutment collar is used.

7. The method according to claim 1, wherein one or more upset pressings are performed on the pipe end before the performance of step (e).

8. The method according to claim 1 wherein two or more upset pressings are performed on the pipe end and the radial subsequent pressing step (e) is carried out only after the last upset pressing.

9. The method according to claim 1, wherein upon the radial subsequent pressing in step (e), the support mandrel is introduced up to a predetermined length which will not cause upset pressing to occur.

* * * * *